United States Patent [19]

Scott et al.

[11] Patent Number: 5,031,943

[45] Date of Patent: Jul. 16, 1991

[54] CLOSURE STRAP FOR FLEXIBLE CONTAINERS

[75] Inventors: Ernest D. Scott, Delray Beach, Fla.; Donald L. Tedder, Carrollton, Ga.; Gregory Scott, Jacksonville Beach, Fla.

[73] Assignee: Edge Technology Corporation, Delray Beach, Fla.

[21] Appl. No.: 626,426

[22] Filed: Dec. 17, 1990

Related U.S. Application Data

[63] Continuation of Ser. No. 503,281, Apr. 2, 1990, abandoned.

[51] Int. Cl.[5] ..... B65D 33/34

[52] U.S. Cl. ..... 292/307 R; 24/16 PB; 292/318

[58] Field of Search ..... 292/307 R, 318, 319, 292/320, 321, 322; 24/16 PB

[56] References Cited

U.S. PATENT DOCUMENTS

| | | | |
|---|---|---|---|
| 2,936,980 | 5/1960 | Rapata | 24/16 PB |
| 3,556,575 | 1/1971 | Farkas | 292/307 R |
| 3,739,430 | 6/1973 | Konke | 24/16 PB |
| 4,365,833 | 12/1982 | Burnett | 292/318 |
| 4,424,994 | 1/1984 | Dowden | 292/318 |
| 4,470,173 | 9/1984 | Adamson | 292/318 X |
| 4,506,415 | 3/1985 | Swift | 292/321 X |
| 4,537,432 | 8/1985 | Meeks | 292/318 |
| 4,580,319 | 4/1986 | Paradis | 292/317 X |
| 4,788,751 | 12/1988 | Shely et al. | 24/16 PB |

FOREIGN PATENT DOCUMENTS

| | | | |
|---|---|---|---|
| 1288128 | 2/1962 | France | 24/16 PB |
| 2163707 | 3/1986 | United Kingdom | 292/318 |
| 2205279 | 12/1988 | United Kingdom | 292/320 |

*Primary Examiner*—Eric K. Nicholson

*Attorney, Agent, or Firm*—Malin, Haley, McHale, DiMaggio & Crosby

[57] ABSTRACT

A one-piece tamper-proof bundling strap comprised of a head-end portion defining an aperture therethrough, the head-end portion being integrally connected to an elongated narrow body portion, the aperture in the head-end portion corresponding generally to the cross-sectional configuration of the body portion. The head-end portion and the body portion have a locking means integrally associated therewith for preventing reverse movement of the body portion relative to the head-end portion when the body portion is looped upon itself and disposed within the aperture of the head-end portion. The locking means is comprised of a plurality of serrations oriented along a portion of the length of the body portion and a plurality of projecting teeth members disposed within said through-aperture adapted to lock against the serrations when the body portion is looped upon itself and drawn through the aperture in the head-end portion. The strap is a one-piece unit constructed of a single, preferably brittle material which will fracture when exposed to tampering forces.

9 Claims, 2 Drawing Sheets

CLOSURE STRAP FOR FLEXIBLE CONTAINERS

This application is a continuation of application Ser. No. 07/503,281 filed Apr. 2, 1990 now abandoned.

BACKGROUND OF THE INVENTION

1. Field of the Invention

This invention relates generally to bundling or tie straps of the character disclosed in U.S. Pat. No. 3,022,557, and more particularly relates to a one-piece bundling strap manufactured from a single material having means to ensure the firm gripping of the tail end of said strap within the apertured self-clinching head end portion thereof against reverse movement of the strap body relative to said head-end portion, means being associated with said bundling strap to indicate the presence of tampering.

2. Prior Art

Flexible bundling straps adapted to be looped about a plurality of loose elements or about the neck of a flexible container and drawn taught thereabout in self-clinching relationship are well known. Bundling or tie straps of this nature are comprised of an elongated flexible strap adapted to be wrapped around a plurality of items to be bundled or about a pouch to be sealed (eg: cloth bag or money-carrying bag), pulled taut and held taut by a relatively rigid tongue means disposed within the head-end of the strap. The head-end has a through-aperture therein adapted to receive the opposite or tail-end of said strap, said tongue means adapted to coact with the tail-end of said strap so as to retain the strap against reverse movement thereof.

An example of a tie or bundling strap of this nature is disclosed in U.S. Pat. No. 3,186,047 to Schwester et al. The apertured head-end portion of Schwester has a self-clinching tongue means that must be inserted into the head-end portion at a predetermined angle using an additional step in the process of manufacturing the strap, increasing the cost thereof. Undetected tampering may be accomplished by prying and removing the tongue means from clinching engagement with the strap body using a thin, sharp implement, and slipping the strap out of the aperture in the head-end. Tampering may also be accomplished by deforming the head-end, thereby releasing the tongue. This would allow the bundled items to be unbundled or the closed pouch to be opened and access gained to the interior thereof. Thereafter the items may be rebundled or pouch reclosed using the same strap without evidence of tampering.

A further effort at providing a tamper-proof bundling strap of the type here under consideration is disclosed in applicants' U.S. Pat. No. 4,902,055, which is directed to a security cap adapted to cover the head-end portion of the bundling strap and thereby preclude access to said tongue means. The cover is comprised of a generally flat sheet of semirigid or rigid material bent along transverse axes into a three-dimensional generally rectangular member. Through openings are provided therein which correspond with the positions through which the thin bundling strap body is passed when in use. Such a structure, however, is relatively costly to produce and time consuming and cumbersome to use, but is nevertheless effective.

It is a principal object of the instant invention, therefore, to provide a tamper-proof self-clinching bundling strap.

It is a further object of the present invention to provide a tamper-proof self-clinching bundling strap having locking means wherein the body portion thereof is adapted to be locked by a novel and inexpensive locking means against reverse movement throughout its length when looped upon itself and drawn through the apertured head-end portion of the strap.

It is a still further object of the present invention to provide a novel tamper-proof self-clinching bundling strap manufactured as a single piece from a relatively brittle material which will fracture when exposed to predetermined tampering forces.

In accordance with these and other objects which will be apparent hereinafter, the instant invention will now be described with particular reference to the accompanying drawings.

SUMMARY OF THE INVENTION

There is disclosed herein a tamper-proof bundling strap comprised of a head-end portion defining an aperture therethrough, said head-end portion being integrally connected to an elongated narrow body portion, said aperture in said head-end portion corresponding generally to the cross-sectional configuration of said body portion. The head-end portion and the body portion having a locking means integrally associated therewith for preventing reverse movement of said body portion relative to said head-end portion when said body portion is disposed within the aperture of said head-end portion. The locking means is comprised of a plurality of serrations oriented along a portion of the length of said body portion and a plurality of projecting teeth members disposed within said through aperture adapted to lock against said serrations when said body portion is looped upon itself and drawn through the aperture in the head-end portion.

The strap is a one-piece unit constructed of a single, preferably brittle material which will fracture when exposed to tampering forces. The strap of the instant invention is ideally suited for use with the applicants' automatic seal tensioning machine disclosed in their U.S. Pat. No. 4,901,775.

To this end, the tail-end of the body portion may be tapered to facilitate unencumbered placement of the body portion within the jaws of the automatic tensioning device.

The teeth members of the locking means project into the aperture in said head-end portion at an angle such that the body portion can be passed through the head-end in one direction with minimal resistance but cannot be moved in the reverse direction because the outer surfaces of said teeth members mate in planar association with a steep trailing surface of any given serration, thereby preventing the body portion from being removed from said head-end portion.

Detents may be disposed in the body portion of the strap, thereby creating stress raisers along which the strap will fracture if tampered with.

The invention will now be described in detail with particular reference to the following drawing figures.

DETAILED DESCRIPTION OF THE PREFERRED EMBODIMENT

Figure 1:
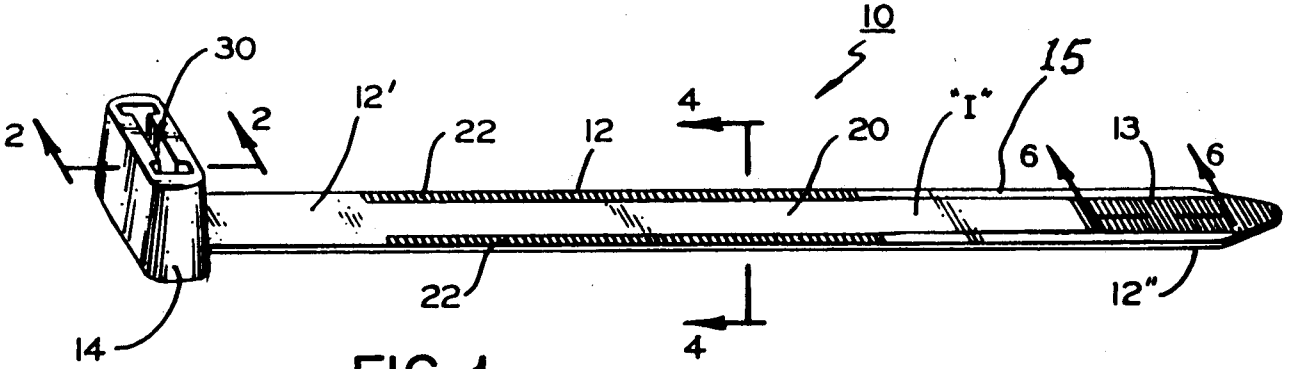
FIG. 1 is a perspective view showing the novel tamperproof bundling strap of the instant invention.
Figure 4:
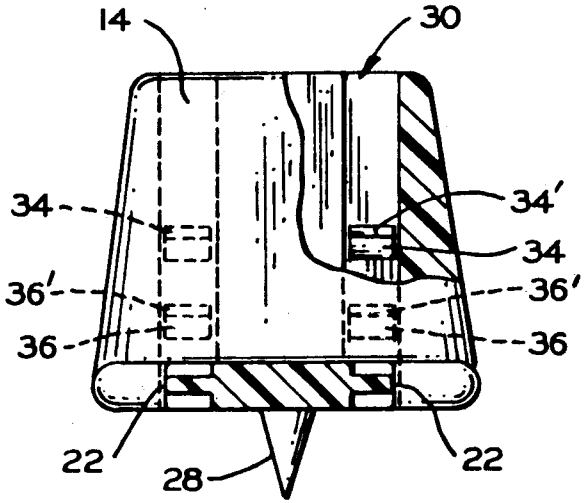
FIG. 4 is a cross-sectional view of the invention taken along lines 4—4 of FIG. 1.

Referring to the drawings, the improved bundling or tie-strap is referred to throughout generally by the reference numeral 10. Said strap 10 is comprised of a narrow elongated body portion 12 having integrally connected at its head-end 12' a head-end member 14 which defines a through aperture 30 therein corresponding generally to the cross-sectional dimensions of said body portion 12. Tail end 12" of strap portion 12 may have integrally formed therein a plurality of spaced, parallel, relatively narrow grooves 13 to act as a finger grip portion.

Figure 2:
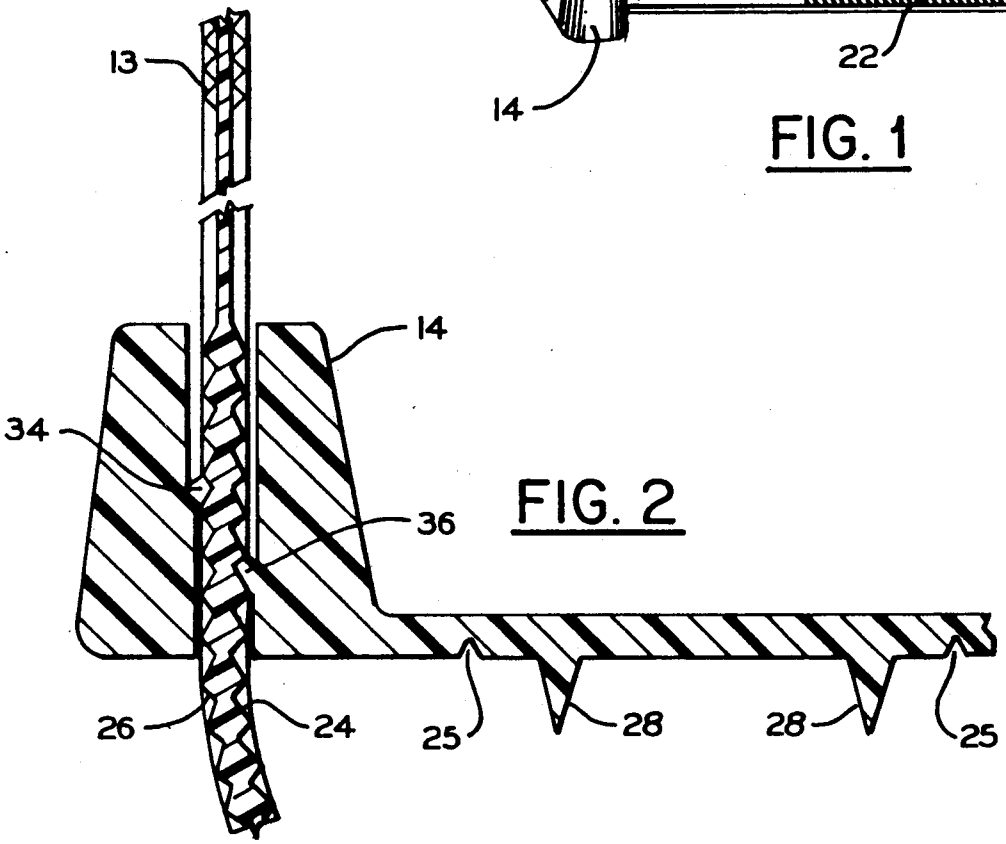
FIG. 2 is a partial sectional view thereof taken along lines 2—2 of FIG. 1.
Figure 6:
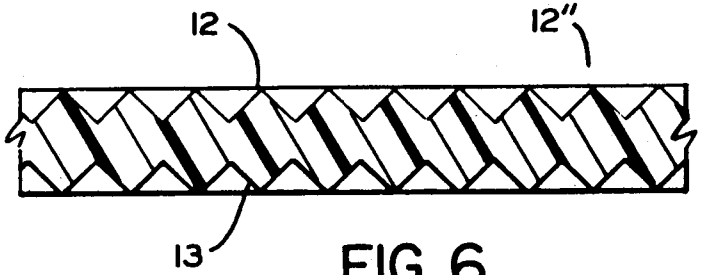
FIG. 6 is a partial cross-sectional view taken along lines 6—6 of FIG. 1.

Serrations 22 are provided along the sides of strap body 12 and are adapted to coact with projecting teeth members 34 and 36 disposed within aperture 30 of head-end 14. The profile of each serration is preferably that of an oblong diamond, wherein the leading surface 24 thereof is longer than the trailing surface 26. The pitch of trailing surface 26 is preferably generally parallel to the mating surface 34' or 36' of projecting teeth members 34 and 36, respectively, when body portion 12 is disposed within aperture 30 of head-end 14. The pitch of the leading surface 24 is longer and less steep in profile to facilitate the insertion of body member 12 into and through aperture 30. Teeth members 34 and 36 are angled as seen in FIG. 2 to allow the strap body 12 to pass thereover during insertion into the head 14 but to prevent removal thereof in the opposite direction.

Teeth 34 and 36 mesh tightly with trailing surfaces 26 so as to prevent tampering with teeth. Teeth 34 and 36 are also hidden by surfaces 24 and 26 providing a shield for said teeth 34 and 36 against tampering.

Figure 5:
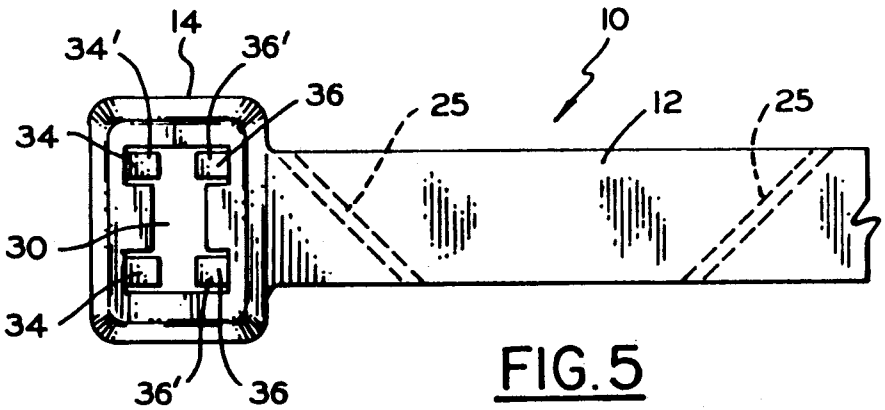
FIG. 5 is a partial plan view showing the head-end portion and teeth members therein.

As best seen in FIG. 5, teeth members 34 and 36 are preferably formed out of the material of strap 10 as through injection molding, casting, or stamping into the preformed strap. In the preferred embodiment, teeth members 34 and 36 are formed integrally with head-end 14 near the outer side edges of aperture 30 and thereby in corresponding position with serrations 22 near the outer sides of strap body 12. Said teeth may in the alternative be positioned more closely to each other and the serrations positioned correspondingly on strap body 12. However, it is preferred that a blank area be left as at I in FIG. 1 to accommodate the imprinting of identification indicia thereon. For example, by using the strap of the instant invention with Applicants' automatic strap tensioning apparatus disclosed in U.S. Pat. No. 4,901,775 and depicted in phantom as A in FIG. 3, the gripping jaws (not shown) of that apparatus which grip strap body 12 near tail end 12" and pull strap 10 taut about the item or items to be bundled may be provided with raised markings which will leave an impression on the strap body in indicia marking area I for identification. Also, or in the alternative, indicia may be imprinted upon head 14 in any convenient manner.

Preferably, at least one detent 25 should be provided in strap body 12 for the purpose of intentionally creating a stress raiser which will rupture upon the imposition of a predetermined tampering force. The broken strap will provide an indication of tampering. The detent may be disposed either at an oblique angle relative to the elongate centerline of strap 10 or normal thereto depending upon the degree of sensitivity to tampering desired. The yield strength of the strap near detents 25 should be slightly lower than the yield strength of the locking means so that the strap 10 will break apart at the detent 25 rather than the strap body 12 pulling out of head 14 should the strap be tampered with by sufficient force. The cross-sectional configuration of the detent 25 may be, preferably, triangular, or may also be semi-circular, rectangular, or any other shape which most effectively produces the desired yield limit.

The improved closure strap of the instant invention is preferably comprised of a single piece of an acetal homopolymer such as Delrin or Delrin II. However, the strap 10 may be comprised of any material exhibiting the physical properties required of the instant invention, namely, that of flexibility, very low degree of malleability, brittleness under compression and mechanical homogeneity to ensure predictable behavior under a wide range of possible applications and conditions.

Figure 7:
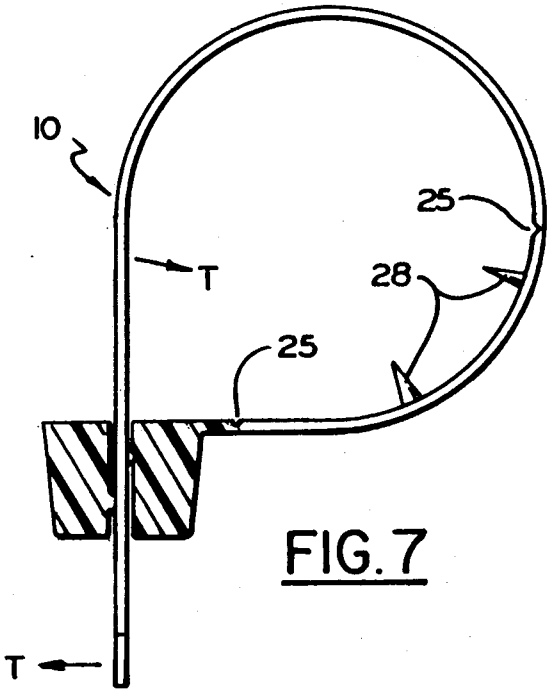
FIG. 7 is an elevational partial cutaway view of the bundling strap of FIG. 1 shown looped upon itself with the body portion thereof and passed through the aperture defined by the head-end portion.

As best seen in FIG. 2, the projecting teeth members 34 are raised somewhat in the vertical direction relative to projecting teeth members 36 in head-end portion 14. Because of the inherent resiliency of the material used to manufacture strap 10, there is a built-in tendency for the strap body portion 12 to twist in the direction of arrows T-T of FIG. 7. This twisting causes the trailing edges 26 of serrations 22 to contact more firmly the surfaces 34' and 36' of teeth members 34 and 36, respectively. Further, it is preferred that said teeth members 34 and 36 be staggered in height relative to each other so as to allow sufficient space within aperture 30 through which body portion 12 may pass on insertion of body 12 into head-end 14. Teeth are staggered to also resist tampering by creating a wedge configuration between the serrations 12 and teeth 34 and 36.

Strap body 12 defines elongated grooves 15 which run along the opposed side edges of both the top and bottom surfaces thereof and extend from tail-end 12" toward head-end 14, ending at the first serration 22. Said grooves 15 provided clearance around teeth 34, 36 for the smooth insertion of strap body 12 into through aperture 30.

In the preferred embodiment, as seen throughout the figures, head-end 14 is inwardly tapered from top to bottom on all four sides so that if compressive forces are applied to the head-end 14 by, for example, a pair of pliers, in an attempt to force teeth members 34 and 36 out of engagement with serrations 22, the compressive forces will be more likely concentrated at a single point on either side of head 14 rather than over a substantial surface area thereof, giving rise to the increased likelihood that the head will shatter and thereby indicate tampering. Head 14 may, however, be configured in alternative shapes including that of a three-dimensional rectangle or cube.

Figure 3:
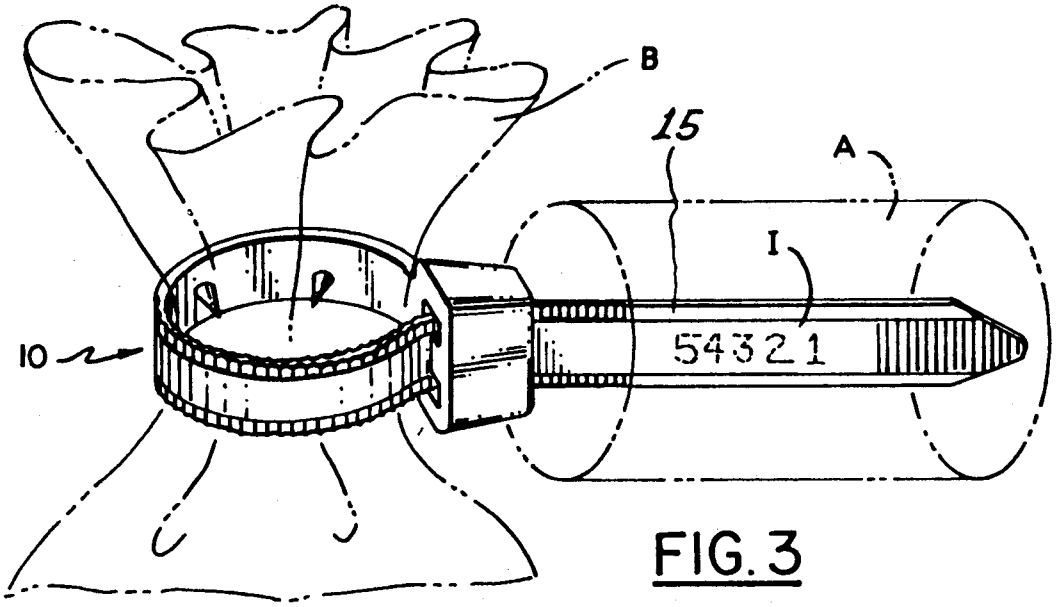
FIG. 3 is a perspective view showing the strap in use about the neck of a flexible container being bundled in association with a tensioning means therefore.

In the preferred embodiment shown in FIGS. 1 and 3, when the strap 10 is used with the automatic strap tensioning device A referred to earlier, the serrations 22 are absent from the initial length of strap body 12 comprised by end segment 12" and indicia marking area I so as to provide a sufficient length of strap 10 which can be fed through the gripping jaws (not shown) of machine A before serrations 22 come into contact with teeth 34 and 36. This allows for easier insertion of the strap body 12 into head-end portion 14 to facilitate the efficient and, if desired, rapid application of the strap about items to be bundled or flexible closure to be sealed. It also provides enough initial length of strap material to allow insertion thereof into the inner mechanism of apparatus A.

It should be noted that indicia marking area I may be textured or smooth as required to more effectively receive indicia thereon.

It is preferred that at least one sharp piercing means or projection 28 be connected to the underside of body portion 12 when the strap of the instant invention is used in connection with a flexible closure such as a bank bag B, said projection 28 acting to restrain strap 10 from relative movement therewith when pulled taut about the neck of bag B. It can therefore be seen in FIGS. 3 and 7 that projection(s) 28 face inwardly toward the object to be bundled B when the body portion 12 is bent backwardly against itself and passed through aperture 30 in headend 14.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. A self-clinching tamper-proof bundling strap, comprising:

a head-end portion, a tail-end portion and a generally flat elongated body portion therebetween, said head-end portion defining an H-shaped transverse aperture therethrough;

locking means associated with said aperture and said body portion for locking the body portion of said strap against relative reverse movement when looped upon itself and fed through said aperture;

wherein said locking means is comprised of:

a plurality of teeth members projecting upwardly and outwardly from said head-end portion into said aperture;

corresponding serrations disposed along opposed side edges of substantially the entirety of said body portion beginning with said head end portion and ending at an indicia receiving means adpated to engage said teeth members in locking engagement against relative reverse movement of said body portion with respect to said head-end portion when said body portion is looped upon itself and fed through said aperture;

wherein said body portion is sized and shaped to correspond generally with the aperture;

said body portion having a top surface and a bottom surface corresponding generally to a top surface and a bottom surface of said head-end portion, respectively;

said side edges being of reduced thickness in profile adjacent said indicia receiving means and extending away from said head-end portion, terminating at said tail-end portion of said strap;

said indicia receiving means for receiving identification markings thereon comprised of a smooth flat area defined by and extending across the entire top surface of said body portion between said opposed side edges.

2. The bundling strap of claim 1, wherein the strap is constructed of a brittle material.

3. The bundling strap of claim 2, wherein said teeth members are formed integrally with and as part of the same material as the remainder of the bundling strap.

4. The bundling strap of claim 2, wherein:

said head-end portion has a bottom and a top, said aperture being a through-aperture passing from the bottom of said head-end portion to the top of said head-end portion;

said teeth members having an upper surface adapted to engage a trailing edge of each serration after the body portion is fed into the head-end portion from the bottom toward the top of said head-end portion and reverse relative movement between the body portion and the head-end portion is attempted.

5. The bundling strap of claim 4, further comprising:

said teeth members having a predetermined yield strength, wherein the exertion of a predetermined force upon said body portion in an attempt to remove said body portion from within said aperture will cause said teeth members to break.

6. The bundling strap of claim 2, wherein the bundling strap is constructed of an acetal homopolymer.

7. The bundling strap of claim 5, further comprising:

at least one sharp projecting member integrally associated with said bottom surface of said body portion adapted to pierce a flexible container being bundled by said bundling strap so as to prevent relative movement between said flexible container and said bundling strap when said bundling strap is engaged about said flexible container.

8. The bundling strap of claim 1, wherein said indicia receiving means is disposed in proximity to said tail-end portion of said strap.

9. The bundling strap of claim 1, wherein said aperture is H-shaped in cross-section.

* * * * *